US007168594B2

(12) United States Patent
Law et al.

(10) Patent No.: US 7,168,594 B2
(45) Date of Patent: Jan. 30, 2007

(54) CHILD-RESISTANT FLUID DISPENSING PUMP

(75) Inventors: Brian Law, Leicester (GB); Jeff Spencer, Leicester (GB); David Prichett, Ft. Wayne, IN (US)

(73) Assignee: Rieke Corporation, Auburn, IN (US)

( * ) Notice: Subject to any disclaimer, the term of this patent is extended or adjusted under 35 U.S.C. 154(b) by 508 days.

(21) Appl. No.: 10/766,357

(22) Filed: Jan. 28, 2004

(65) Prior Publication Data

US 2005/0173461 A1 Aug. 11, 2005

(51) Int. Cl.
*B67D 5/33* (2006.01)

(52) U.S. Cl. ..... 222/153.13; 222/321.9

(58) Field of Classification Search ..... 222/153.13, 222/321.9

See application file for complete search history.

(56) References Cited

U.S. PATENT DOCUMENTS

| | | | |
|---|---|---|---|
| 5,405,057 | A | 4/1995 | Moore |
| 6,186,365 | B1 | 2/2001 | Dejonge |
| 2003/0150876 | A1 | 8/2003 | Walters |

*Primary Examiner*—Philippe Derakshani
(74) *Attorney, Agent, or Firm*—Woodard, Emhardt, Moriartyi, McNett & Henry LLP

(57) ABSTRACT

A childproof lock for a reciprocating fluid dispensing pump of the type that is threaded into a locked position. In one set of embodiments, the lock requires simultaneous displacement in a direction other than unthreading to permit reciprocation of the pump. In another set of embodiments, fluid flow is permitted only when a lock is simultaneously displaced in a direction other than reciprocation of the pump.

33 Claims, 8 Drawing Sheets

CHILD-RESISTANT FLUID DISPENSING PUMP

BACKGROUND OF THE INVENTION

The present invention relates generally to the field of dispensing pumps for fluids and more particularly toward pumps of this type that have a child proof lockable feature.

There are classes of fluid dispensers for both consumer and industrial use in which a reciprocating pump element is threaded into a housing for locking in a retracted position for storage and shipping. A number of proposals have been made to introduce a locking childproof function in dispensers of this type.

U.S. Pat. No. 5,405,057 is an example of such a device. A reciprocating plunger is required to be rotated into alignment with recesses and notches to permit reciprocation. The problem with this type of device is that inadvertent manipulation by a child could bring the plunger into alignment so as to permit reciprocation.

The present invention provides an effective and novel alternative to the childproof design mentioned above. It involves the incorporation of various locking mechanisms that require displacement of an operator-manipulated component in a direction other than the direction required to unthread the plunger for pumping movement. This displacement must be done simultaneously with the unthreading movement to minimize, if not eliminate, the possibility of unauthorized plunger pumping.

SUMMARY OF THE INVENTION

One embodiment of the present invention concerns a dispenser comprising a pump assembly having a reciprocating plunger for pumping fluids, the plunger being rotationally threaded into a locked position and rotationally unthreaded to permit reciprocation. An operator-manipulated apparatus for selectively locking and unlocking the plunger requires displacement other than rotational displacement substantially simultaneously with rotational movement of the plunger to enable the plunger to be unthreaded to permit reciprocation.

Another embodiment of the present invention applies to a pump assembly having a reciprocating plunger for pumping fluids. A selective flow control valve is displaceable in a predetermined direction between a first, flow blocking position, and a second flow permitting position. The selective flow valve has a lock requiring substantially simultaneous displacement in a direction other than the predetermined direction to permit displacement to the second position to permit flow.

One object of the present invention is to provide an improved fluid dispensing pump with a lockable feature.

Related objects and advantages of the present invention will be apparent from the following description.

DESCRIPTION OF THE PREFERRED EMBODIMENTS

Figure 2:
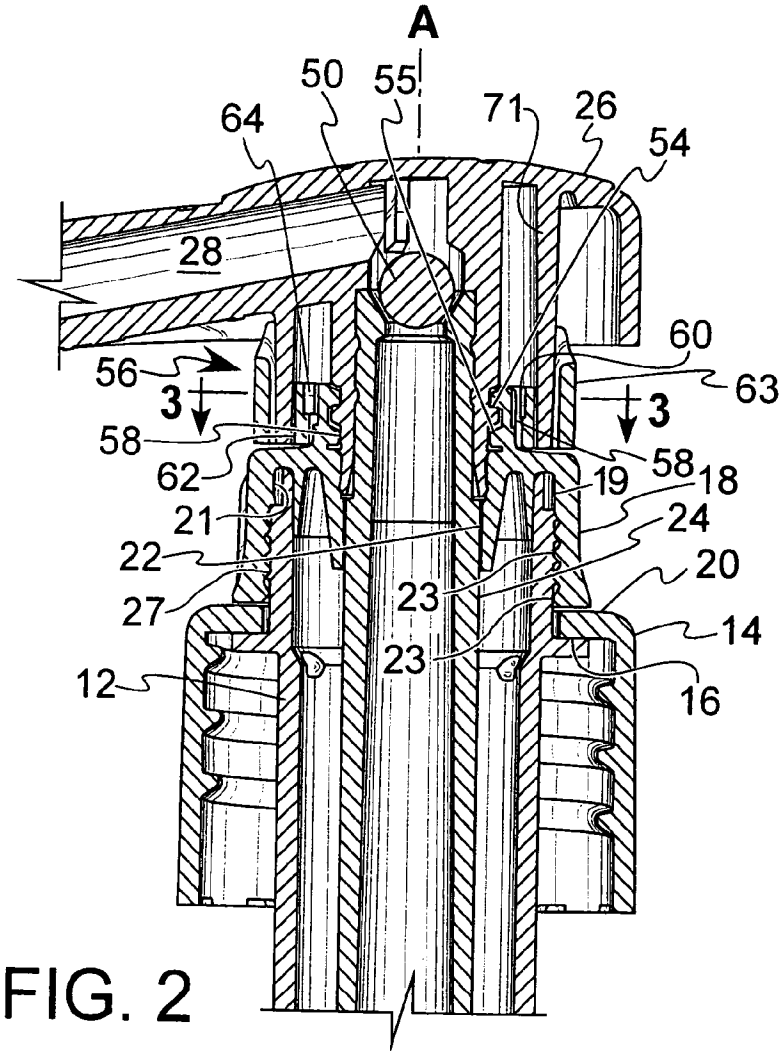
FIG. 2 is an expanded section view of the head in FIG. 1 illustrating a first locking mechanism in its locked position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
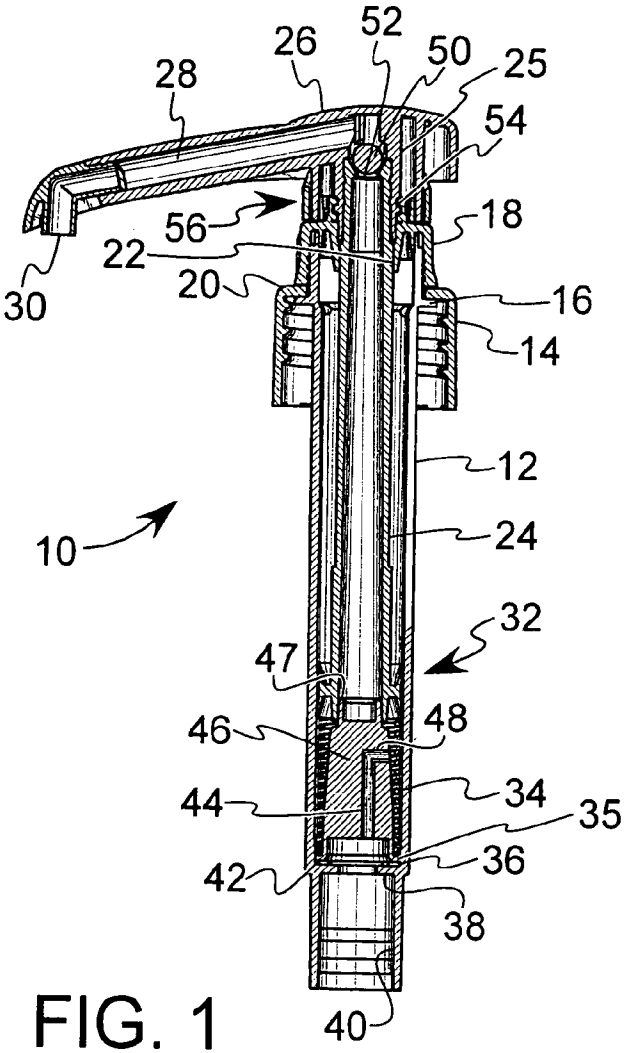
FIG. 1 is a longitudinal section view of a fluid dispensing pump with which the present invention is used.

FIG. 1 illustrates a fluid dispenser 10 in which several embodiments of the present invention may be employed. The dispenser 10 comprises a substantially tubular outer element 12 coupled to a collar 14 by means of an integral outwardly extending shoulder 16 on tubular element 12 and a retaining cap 18 capturing the head 20 of collar 14. Retaining cap 18 has ribs 19 that inter fit with corresponding recesses (or spaces between adjacent ribs) 21 on the end of tubular element 12. Cap 18 is snapped in place over the end of tubular element 12 by barbs 23 that are captured by circumferential grooves 27 on the adjacent end of tubular element 12. As a result, retaining cap 18 is not rotatable relative to tubular element 12. Collar 14 is connected to a suitable fluid reservoir (not shown) from which fluid is to be dispensed. For the sake of simplicity in illustrating the present invention, collar 14 is shown as a threaded connection. In the event it is deemed necessary to provide an anti-rotation feature between the fluid dispenser 10 and the fluid reservoir, the snap fit and anti-rotation configuration of retaining cap 18 may be employed for collar 14. Retaining cap 18 has a central opening 22 that receives a tubular pumping element 24.

Pumping element 24 is affixed to a central tubular extension 25 of a dispensing head 26 having an internal passageway 28 and an outlet or spout 30. In its unlocked position, described in detail below, pumping element 24 is reciprocated in tubular element 12. Pumping element 24 extends to and connects with an integral annular sealing element 32 that sealingly engages the interior of tubular element 12. The sealing element 32 receives an appropriate spring 34 in the lower end of tubular element 12. Spring 34 abuts a flange 35 on a plunger plug 46, also located in the lower end of tubular element 12. A check valve 36 is sandwiched between flange 35 and an integral shoulder 38 of tubular element 12. An open end 40 of tubular element 12 receives fluid and a central opening 42 provides flow into the interior. Check valve 36 has a flapper element (not shown) lying across opening 42 to unseat from opening 42 thus permitting fluid flow only into the lower end of tubular element 12 from opening 42. Plunger plug 46 has a plurality of axial passages 44 connecting with radial passages 48 to permit flow between the plunger plug 46 and the interior of tubular element 12. Plunger plug 46 has an upper closed end 47 that is received in the lower open end of pumping element 24 when it is in its fully retracted and locked position illustrated in FIG. 1. As a result, the interior of pumping element 24 is positively sealed against fluid flow through opening 42 in the locked position. A check valve in the form of a check ball 50 seats against an upper outlet 52 of tubular pumping element 24 to permit flow of fluid only in a direction towards outlet 30. Pumping element 24 has threads 54 that are threaded into corresponding threads 55 (see FIG. 2) in retaining cap 18 to place pumping element 24 in the locked or retracted position of FIG. 1.

The pumping element 24 is unlocked by threading head 26 relative to retaining cap 18 in a counter-clockwise direction to permit pumping element 24 to displace from the closed end 47 of plunger plug 46 thereby permitting fluid flow into the interior of pumping element 24. As the pumping element 24 and head 26 are moved to the fully extended position by the force of spring 34, check ball 50 seats against upper outlet 52 and the vacuum generated in the interior of tubular pumping element 24 draws fluid past check valve 36 and into the interior of pumping element 24. This continues until a maximum stroke at which point the pumping element is pressed into the base cutting off flow through check valve 36 and permitting flow past check ball 50 through outlet 30.

According to the present invention, a locking mechanism, generally indicated at 56, is provided at the junction between head 26 and retaining cap 18 to prevent unauthorized opening by a child. Locking mechanism 56 may take a number forms but in each form it serves to permit unthreading of the head 26 from retaining cap 18 only upon simultaneous displacement in a direction other than rotation of the head.

Figure 4:
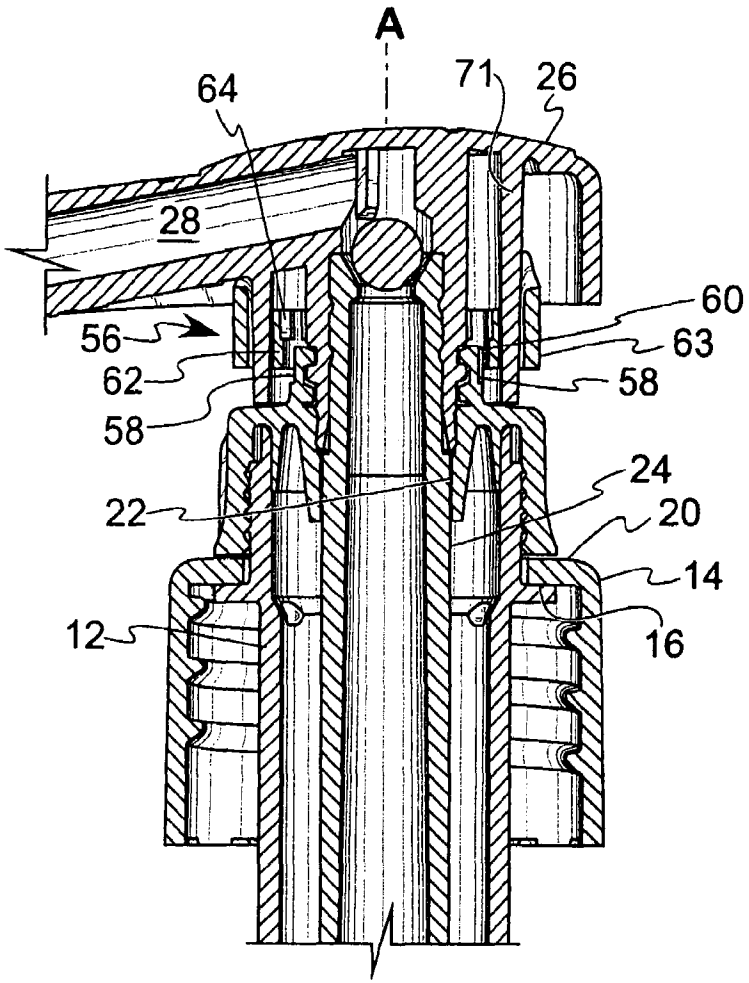
FIG. 4 is an expanded section view of the locking mechanism of FIG. 2 shown in an unlocked position.
Figure 3:
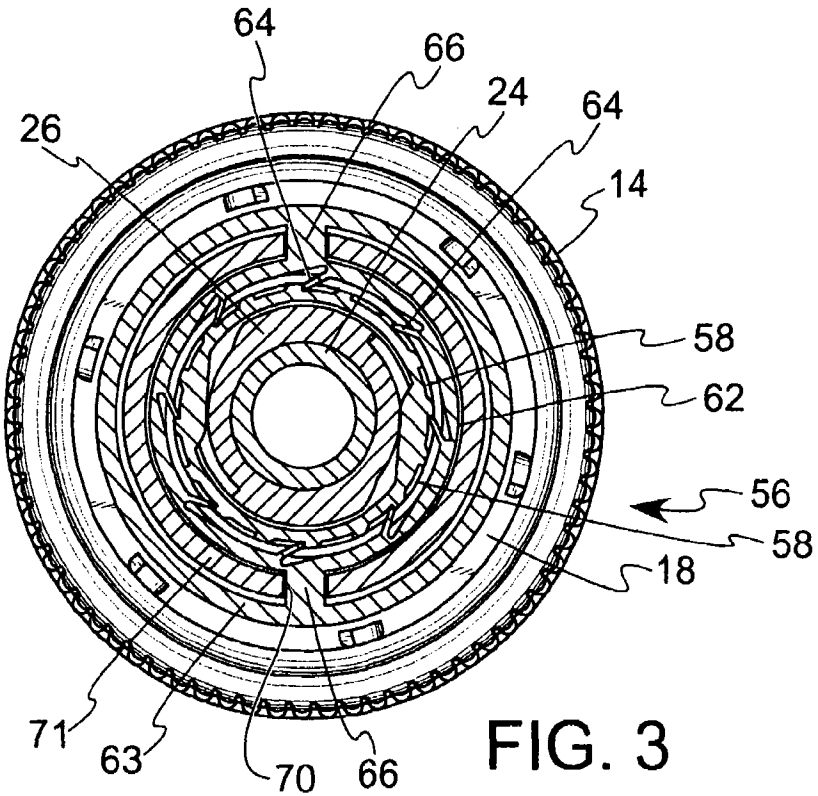
FIG. 3 is a cross sectional view of FIG. 2 taken on lines 3—3 of FIG. 2.

Locking mechanism 56 in FIGS. 2, 3 and 4 comprises a ratchet in the form of spaced recesses 58 in an arcuate configuration around the circumference of retaining cap 18. Recesses 58 each have an open upper end 60. As shown particularly in FIG. 3 locking mechanism 56 further comprises a ring 62 concentric with the circumferential arrangement of recesses 58. Ring 62 is connected to head 26 so that it is displaceable axially relative to the longitudinal axis A of the pumping element 24. Ring 62 has a plurality of pawls 64 which are positioned to extend into recesses 58. As shown particularly in FIG. 3 pawls 64 are flexible tabs biased radially inward in a direction between radial and tangential and into recesses 58 so that when recesses 58 and ring 62 are aligned in the position of FIG. 2, pawls 64 permit rotation of ring 62 only in a clockwise direction. Ring 62 and pawls 64 are made from an appropriate material that has good moldability, relatively low cost, and is widely compatible with a range of materials and fluids. Polypropylene is suitable for this purpose although there are other materials that may be employed. As is evident, rotation in the counterclockwise direction is resisted by the end of pawls 64 abutting recesses 58.

Figure 5:
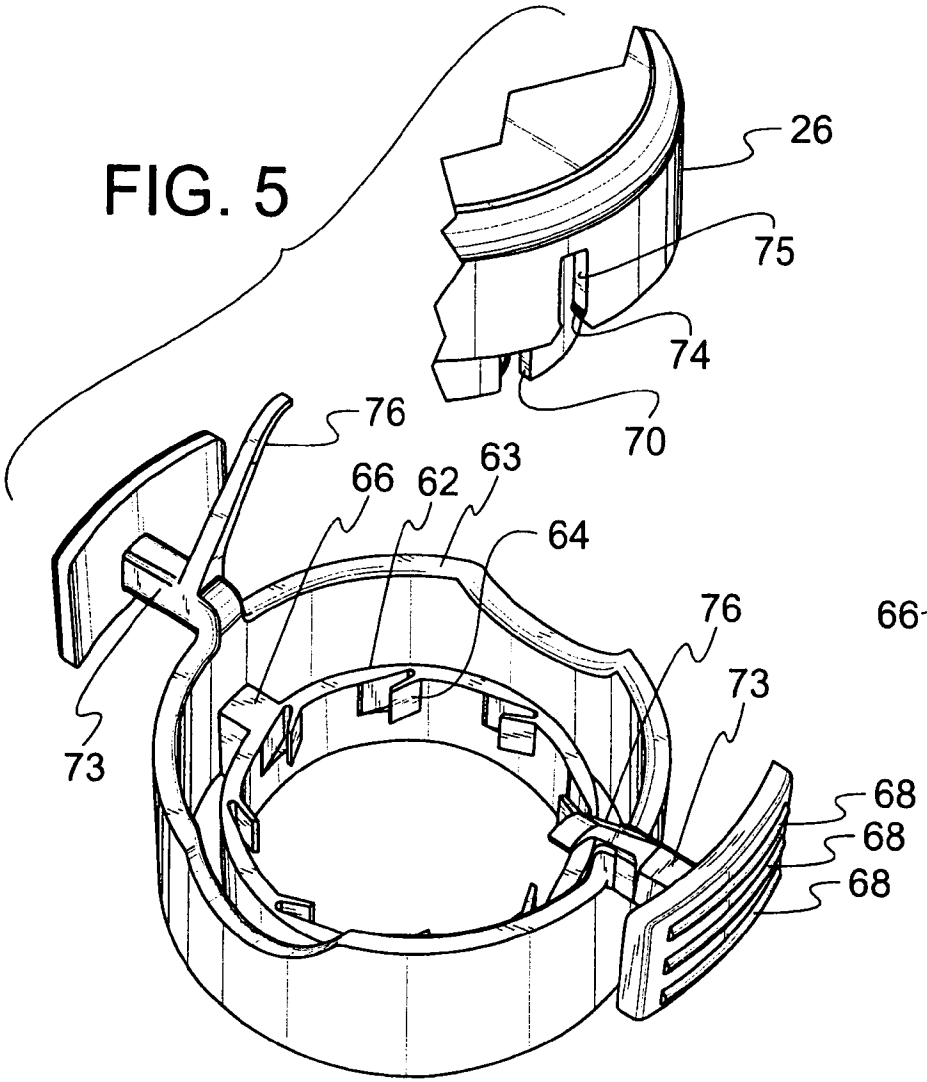
FIG. 5 shows a perspective view of the portion of the locking apparatus employed in FIGS. 2, 3 and 4 with one alternative operator manipulation scheme.

Ring 62 is connected to an outer ring 63 by means of a pair of oppositely-disposed arms 66 extending radially outward therefrom. Arms 66 are received in open-ended, elongated slots 70 formed in a central cylindrical element 71 of head 26. As shown in FIG. 5, additional arms 73 extend radially outward from ring 63 and through elongated slots 75 in head 26. Slots 75 are open-ended and have projections 74 extending inward so that arms 73 may be snapped into place on head 26 and are displaceable within elongated slots 75. The length of slots 75 are selected so as to permit ring 62 to be displaced sufficiently to its upper position shown in FIG. 4 so that the pawls 64 clear recesses 58. In this position, ring 62 and thus housing 26 may be rotated in a counterclockwise direction to unscrew the pumping element 24 from the head and permit reciprocation. The assembly of the ring 62, pawls 64, arms 66, and outer ring 63 and arms 73 is axially biased towards the position FIG. 2 where the pawls 64 engage recesses 58 by a pair of integral leaf springs 76 which act against the inside of head 26 to urge ring 62 in a downward position.

When the fluid dispenser of FIGS. 1–3 is shipped, the housing 26 is fully threaded into the base housing 18. In this position the pump is not permitted to reciprocate and therefore pump fluid. Any movement to unlock the pump assembly from the threaded connection is resisted by the action of the pawls 64 against recesses 58. It is only when arms 73 are simultaneously displaced axially upward and the pump rotated in a counterclockwise direction that it may be moved from its locked position to the unlocked position for reciprocation and pumping of fluids. Thus, the locking mechanism requires a displacement other than rotational displacement to place the pump in an operative condition.

Figure 6:
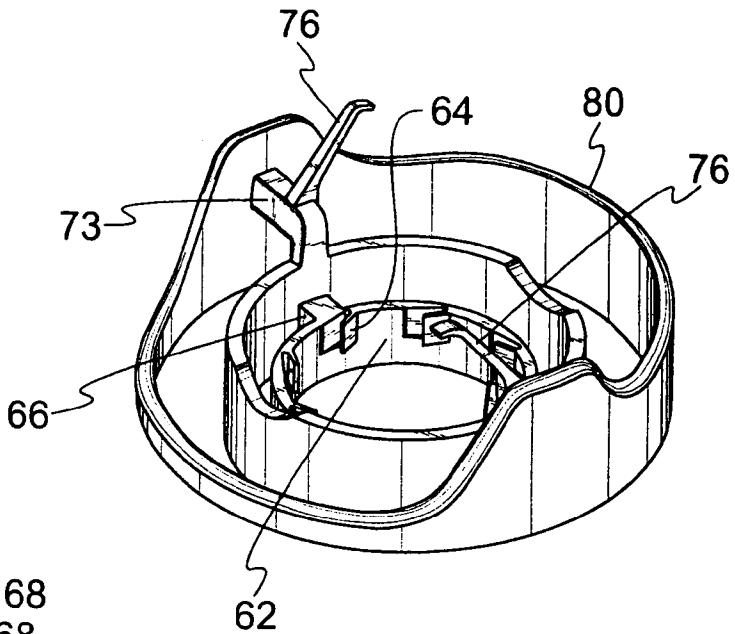
FIG. 6 is a perspective view of the portion of the locking mechanism employed in FIGS. 2, 3 and 4 but with an alternative operator manipulated portion.

Arms 73 may be displaced by different operator engageable components. FIGS. 5 and 6 show alternative construction of the assembly including the inner ring 62.

FIG. 5 shows a pair of pads 68 on the outer end of arms 73 so that they are positioned on the outside of head 26. Pads 68 are pulled upwards simultaneously with the counterclockwise movement of head 26.

FIG. 6 shows an actuating ring 80 connected to the outer ends of arms 73 so that the actuating ring 80 is positioned on the outside of head 26. Actuating ring 80 is pulled upwards simultaneously with the counterclockwise movement of head 26.

Figure 8:
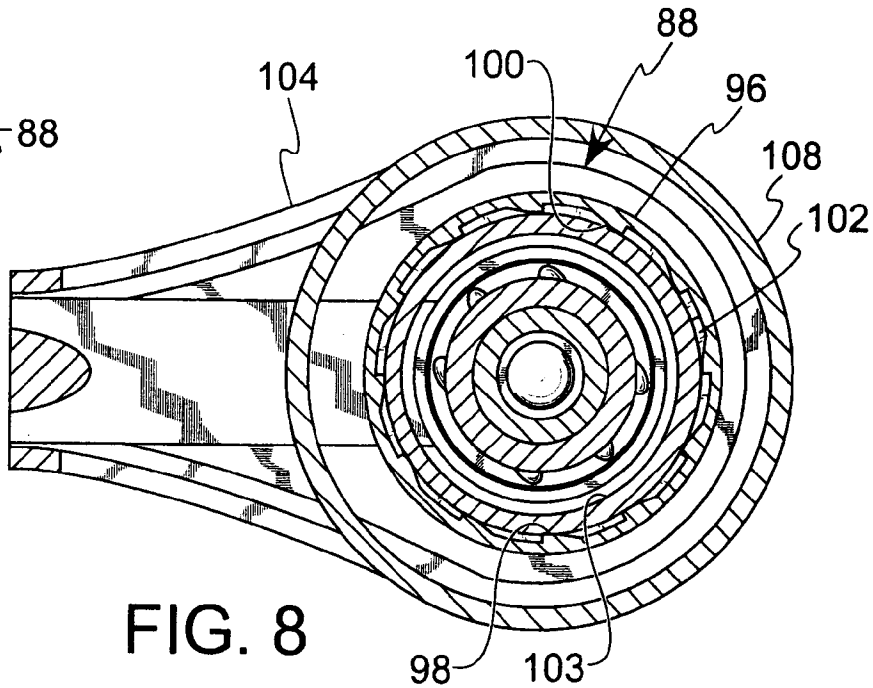
FIG. 8 is a cross sectional view of FIG. 7 taken on lines 8—8 of FIG. 7.
Figure 7:
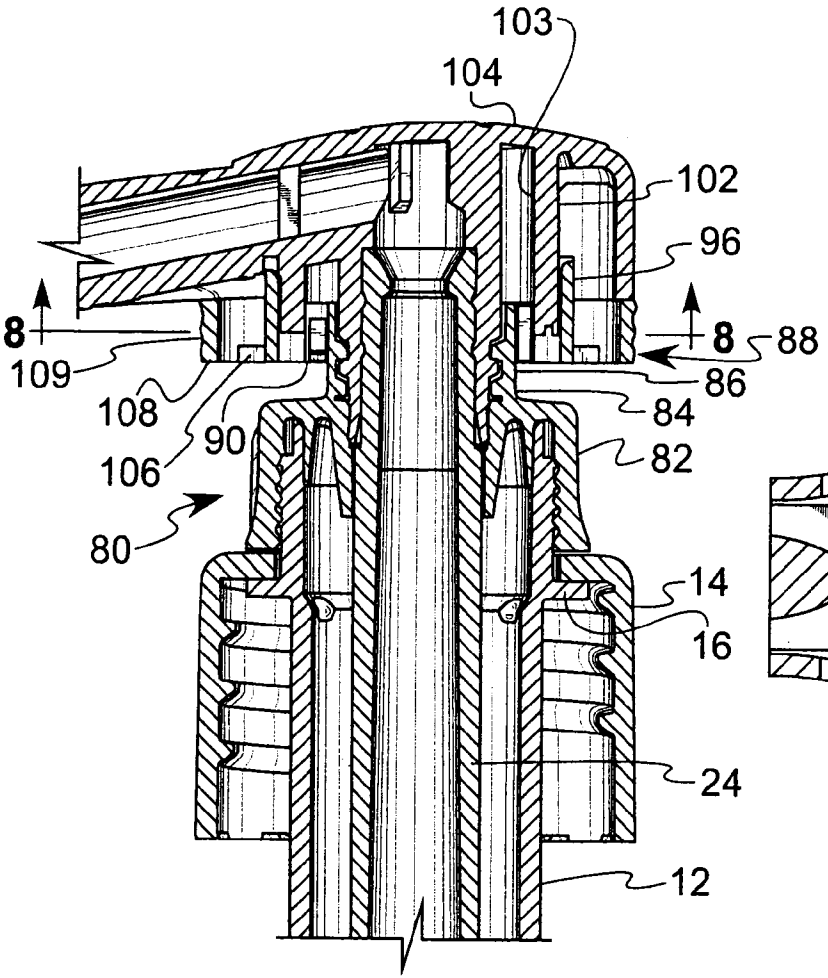
FIG. 7 is an expanded sectional view of the dispensing pump of FIG. 1 but with an alternative locking mechanism in its locked position.
Figure 9:
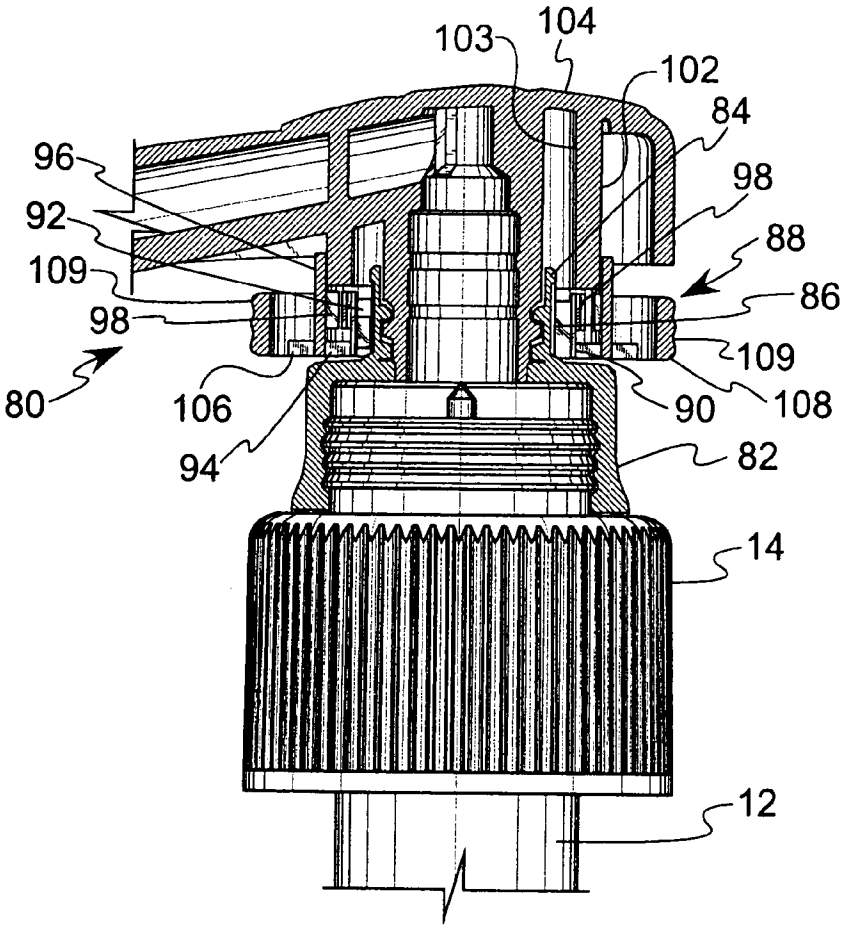
FIG. 9 is the longitudinal section view of FIG. 7 showing the locking mechanism in its unlocked position.

Referring to FIGS. 7, 8 and 9 there is shown an alternative mechanism, generally indicated at 80, for locking the pumping element 24 from reciprocating movement. The locking assembly 80 comprises a cap 82 snap fitted onto tubular element 12 and also forming a retainer for threaded end cap 14. Cap 82 has a concentric extension 84 having a ratchet defined by a plurality of arcuate recesses 86 about its circumference. Recesses 86 are substantially rectangular in configuration. A ring assembly 88 is concentric with and surrounds extension 84 and recesses 86. The ring assembly 88 comprises an inner-ring 90 having a plurality of flexible tabs 92 rectangular in shape and biased radially inward in a direction between radial and tangential. Tabs 92 project into recesses 86 to permit movement of ring 90 and its associated elements only in a direction clockwise relative to extension 84. Ring 90 further comprises arms 94 that are integral with and extend radially outward to an intermediate ring 96. Ring 96 has a plurality of ratchets 98 spaced around its circumference. These ratchets 98 comprise raised sections with forward ramps 100. The ratchets 98 are positioned between corresponding ratchets 102 integral with a tubular extension 103 of head 104 for the pump assembly. As shown particularly in FIG. 8, the ratchets 102 align with ratchets 98 to permit limited relative rotation between head 104 and the ring 96 when the ratchets are aligned with one another. In this position, the ratchets 98 and 102 form a dog clutch causing the rotation of the head 104 to be limited to a clockwise rotation when the dogs are engaged. Ring 96 has additional radial arms 106 extending outward to an actuating ring 108 having a ribbed peripheral surface 109. The ring 90 and associated elements are retained on projection 84 by the upper and lower walls of rectangular recesses 86 which capture flexible tabs 92.

The locking assembly 80 is axially displaceable between the upper position shown in FIG. 7 and a lower position shown in FIG. 9. In the position of FIG. 9, the ratchets 102 clear ratchets 98 thus permitting counterclockwise rotation of head 104. So long as the actuating ring 108 is held in the lower position of FIG. 9, an operator is free to unthread head 104 thus permitting movement of the head to its operating condition where reciprocation and pumping is permitted.

When it is desired to restore the pumping element 24 to its locked position, it is reciprocated to its lower position where the threads between the head 104 and extension 84 become engaged. Further rotation of the head 104 into the threads causes axial movement and the ratchets 102 and 98 act as a dog clutch to, in turn, drive ring 90 in a clockwise direction. The flexible tabs 92 move out of each succeeding rectangular recess 86 to the point where the cover 104 is fully threaded into the base for a locking position. At this point, movement in a counterclockwise direction is resisted because of the tabs 92 abutting against the edges of the rectangular recesses 86.

Figure 10:
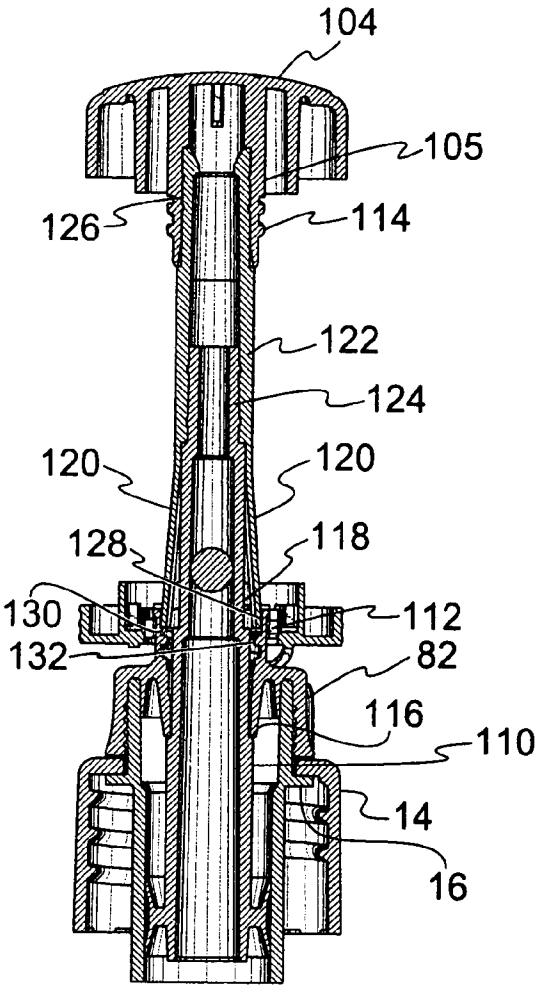
FIG. 10 is a longitudinal section view of a fluid dispensing apparatus with an alternative locking mechanism for the pump assembly.

FIG. 10 shows a further locking embodiment of the present invention in connection with the locking mechanism shown in FIGS. 7, 8 and 9. However, it should be noted that the locking mechanism of FIG. 10 can be used in connection with any one of the embodiments in the present invention. As shown in FIG. 10, an end cap 14 is sandwiched between the flange 16 and a retaining cap 82 into which a pumping element 110 is reciprocated. Pumping element 110 may be reciprocated downward from the position of FIG. 10, upon unlocking of the mechanism described below. At or near the lowermost position, internal threads 112 on end cap 82 engage corresponding external threads 114 on a tubular extension 105 of head 104 for locking the pumping element 110 in its lower position. The pumping element 110 has a shoulder 116 which limits upward reciprocation by abutting the inner portion of retaining cap 82. Pumping element 110 has a pair of elongated recesses 118 which receive elongated tabs 120 on opposite sides of the pumping element 110. Tabs 120 are flexible and formed to be biased toward a radially outward position as shown in FIG. 10. Tabs 120 are integral with a tubular section 122 telescoped over a reduced diameter section 124 of pumping element 110. The upper end of section 122 is connected to a recess 126 in tubular extension 105 of head 104. As shown particularly in FIG. 10, when the pumping element 110 is at the top of its stroke flexible tabs 120 expand outwardly against an opening 128 in retaining cap 82. In this position, downward movement of the pumping element 110 to its retracted position is prevented by abutment of ends 130 of tabs 120 against a shoulder 132 in opening 128.

Thus, the plunger is locked in its outer most position so as to prevent downward reciprocation and pumping. In order to permit movement of the plunger in a downward direction, the tabs 120 must be simultaneously compressed to a retracted position so that the ends 130 clear shoulder 132 as the head 104 and associated components is moved in a downward direction. Typically, during operation by an adult, the cap 104 is not extended to the point where it reaches its maximum extension for locking.

Since the plunger 110 is biased towards an outer position by the spring 34 (not shown in FIG. 10) the plunger will extend to its maximum position when the fluid dispensing unit is left unattended and be locked, thus preventing a child from pumping fluids simply by pressing the plunger.

Figure 13:
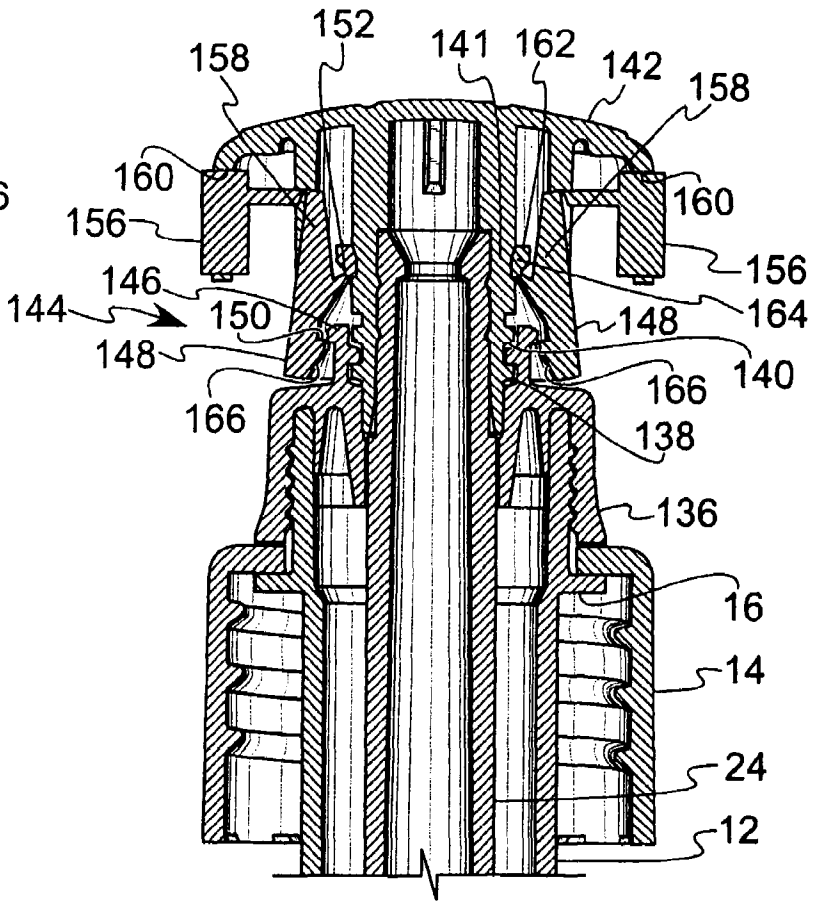
FIG. 13 is a longitudinal section view of FIG. 1 but with the locking mechanism in its unlocked position.
Figure 11:
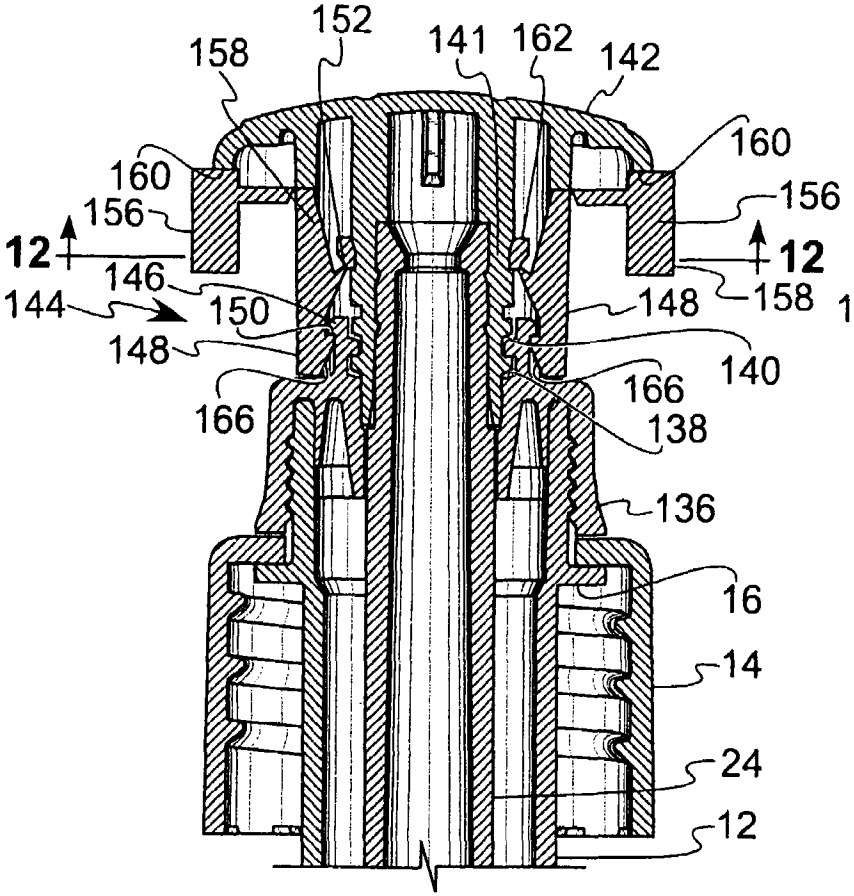
FIG. 11 is a longitudinal section view of an alternative locking mechanism for the pump assembly of FIG. 1 showing the apparatus in its locked position.
Figure 12:
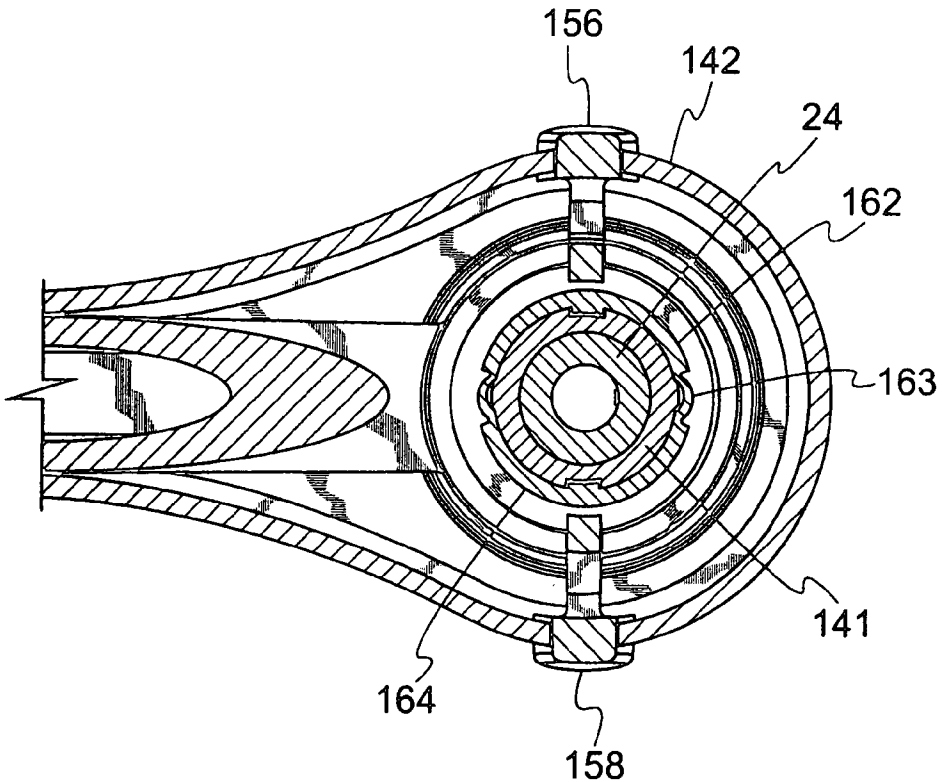
FIG. 12 is a cross sectional view of FIG. 11 taken on lines 12—12 of FIG. 11.

FIGS. 11, 12 and 13 show still another embodiment of the locking mechanism of the present invention. FIG. 11 shows an outer tubular element 12 and the collar 14 retained between a flange 16 and a retaining cap 136. Retaining cap 136 has threads 138 which cooperate with outwardly facing threads 140 on a central tubular element 141 into which pumping element 24 is telescoped and secured to a head 142. Head 142 is threaded in a clockwise direction to the inwardly facing locking position where pumping element 24 is fully retracted and an unthreaded to an operative position where pumping element 24 is free to reciprocate.

A locking mechanism generally indicated at 144 is provided to lock the pumping element 24 in its lower position. Locking mechanism 144 comprises a flange 146 integral with the end of retaining cap 136. A plurality of dogs 148, herein shown as an opposed pair, each comprise a lip 150 which is captured by flange 146 when the head 142 is in its retracted position and the dogs 148 abut or are adjacent retaining cap 136. Dogs 148 have a pivot section 152 that is radially inward from flange 146 and adjacent inner tubular element 141 of head 142.

A button 156 is connected with the upper end 158 of each dog 148. Buttons 156 are received in holes 160 in head 142. The buttons 156 and holes 160 are circular so that the buttons 156 (and therefore dogs 148) are retained in place within the head 142 but permitted to move in a radial direction. A circular ring 162 ties the dogs 148 together and is contained within a groove 164 on tubular element 141. As particularly shown in FIG. 12, ring 162 has a pair of locally thinned sections 163.

Ring 162 is connected to dogs 148 in such a manner as to flexibly bias the buttons 156 to their outer most position wherein the lips 150 of dogs 148 are captured by flange 146. When the locking mechanism 144 is in the position illustrated in FIG. 11, any rotational movement of head 142 will cause an axial upward movement. Since the lips 150 on the dogs 148 are captured by flange 146, further axial movement is resisted. Because the pivot section 152 for dogs 148 is radially inward from the periphery of flange 146, further movement in an axial direction pulls the lips 150 into flange 146.

When it is desired to unlock the pumping element 24, buttons 156 are simultaneously pressed inward as shown in FIG. 13 so that the lips 150 clear flange 148 and axial movement of head 142 is unimpeded as it is unthreaded. The head 142 continues to be unthreaded to a position where it, and the pumping element 24, may be reciprocated to pump fluid.

When the pumping operation is completed and the locking mechanism 144 is again set in the position of FIG. 11, the head 142 and pumping element 24 are depressed to the retracted position where the threads 138 and 140 engage one another. As the head 142 is threaded into the retaining cap 136, the dogs 148 move axially downward. A ramp surface 166 is provided at the lower ends of dogs 48 so that as they are moved downward they deflect outward to the point where the lips 150 can then be captured by flange 146.

Figure 14:
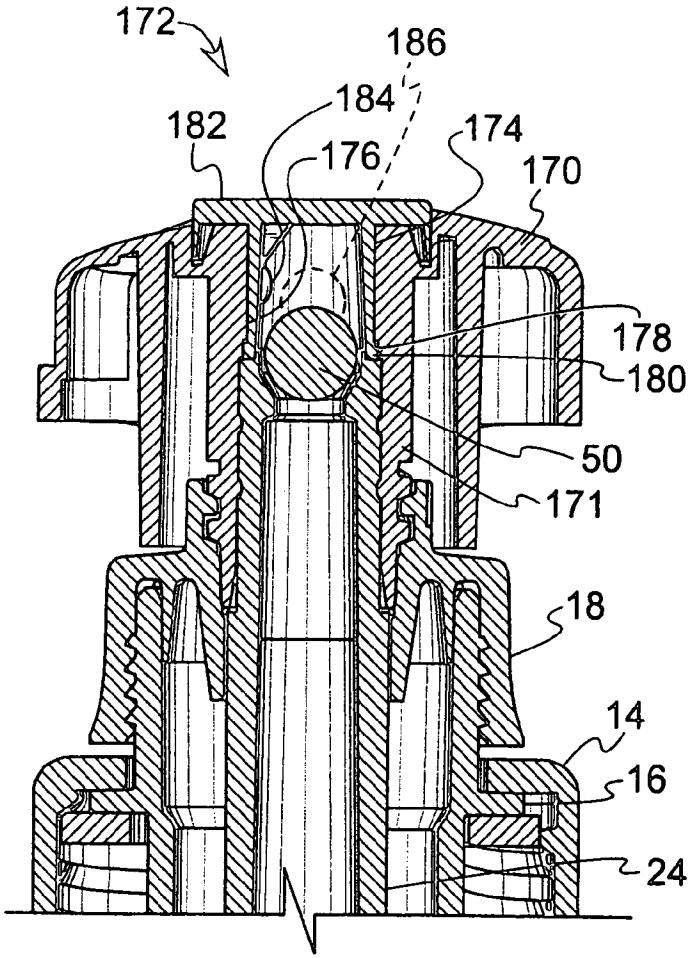
FIG. 14 is a longitudinal section view of the dispensing head of FIG. 1 showing a mechanism by which flow through the dispensing spout is selectively locked and unlocked.

FIG. 14 shows still another embodiment of the present invention which can be employed either independently of, or in conjunction with, the locking mechanisms of FIGS. 1–13. This locking mechanism focuses on controlling the flow of fluid from the pumping head. As shown particularly in FIG. 14, the pumping element 24 is guided for reciprocating movement within retaining cap 18 and is connected to a central tubular element 171 of a head 170. The primary fluid flow path through the interior of pumping element 24 goes past check ball 50 to a flow control valve 172 comprising a sleeve 174 received in bore 176 of central tubular element 171. A shoulder 178 at the base of bore 176 receives a lip 180 on sleeve 174 to hold it in place. A head 182 on the upper end of sleeve 174 is rotated as described below to cause a side opening 184 to be registered with an outlet passage 186 (shown in dashed lines) only when the valve 172 is rotated to a predetermined position. Movement of the valve 172 away from that position causes flow to outlet passage 186 to be blocked by the solid sidewall of sleeve 174.

Figure 15:
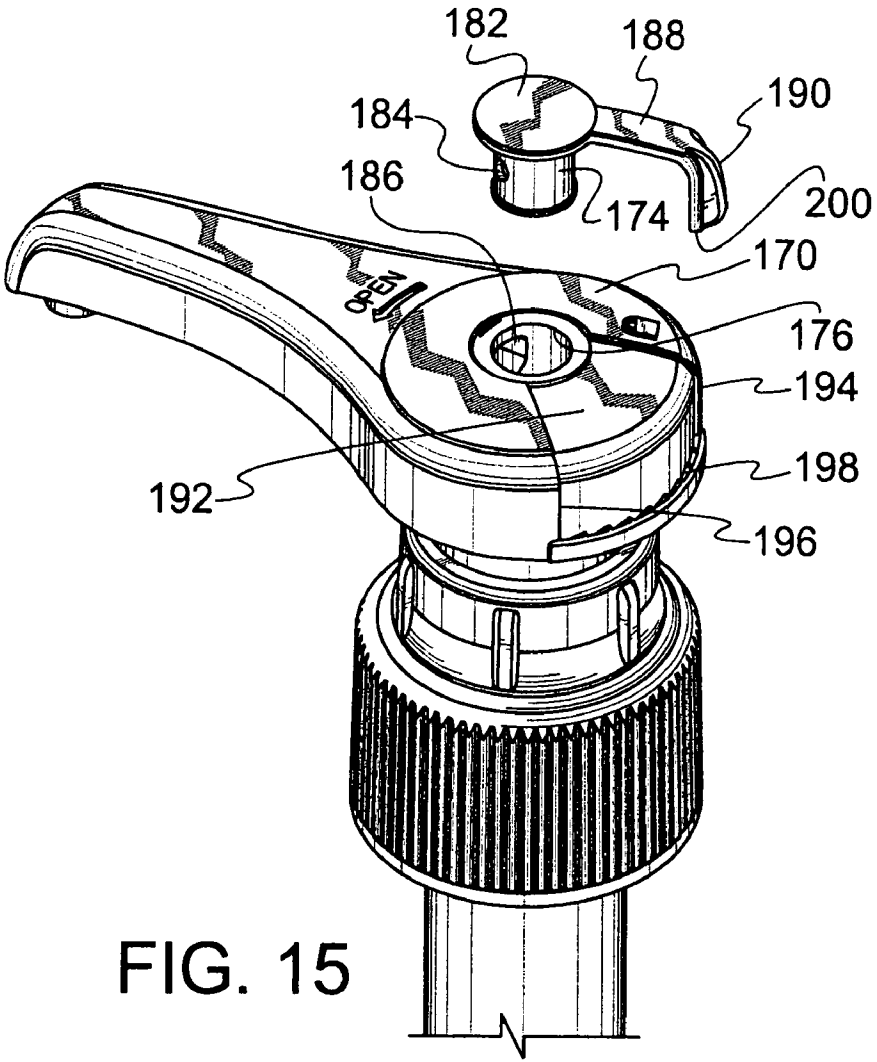
FIG. 15 is a perspective view of the head of FIG. 14 showing a first locking mechanism for flow.

As shown in FIG. 15, the head 182 may be rotated by an integral radial arm 188 and handle 190 extending generally at right angles to arm 188. Arm 188 and handle 190 are received in an arcuate recess 192 in cap 170. Arm 188 and handle 190 are displaceable between a first end wall 194 for the locked position and a second end wall 196 in the unlocked position. An arcuate ratchet 198 extends between the end walls 194 and 196. Handle 190 has a pawl 200 which engages ratchets 198 when sleeve 174 is received in bore 176. When arm 188 is rotated in a counterclockwise position so that arm 188 and handle 190 abut wall 194, outlet port 186 is closed off. Arm 188 and handle 190 have sufficient flexibility so that pawl 200 is permitted to move along ratchets 198. In this position, flow through outlet port 186 is prevented, even though (in the absence of additional locking devices) the pump cover 170 may be unthreaded from its downward and locked position. In order to enable flow, the arm 188 and handle 190 are flexed so that pawl 200 is clear of ratchets 198 thus permitting the arm 188 and 190 to be rotated in a clockwise direction to enable flow of fluid because port 184 registers with outlet port 186. It is to be noted that this embodiment of the locking mechanism requires a simultaneous movement of the arm 188 and 190 in a plane intersecting the axis of flow control valve 172 simultaneously with the rotation of that valve. Accordingly, a child would not be able to open flow simply by rotating the flow control valve 172 in an elementary way.

Figure 16:
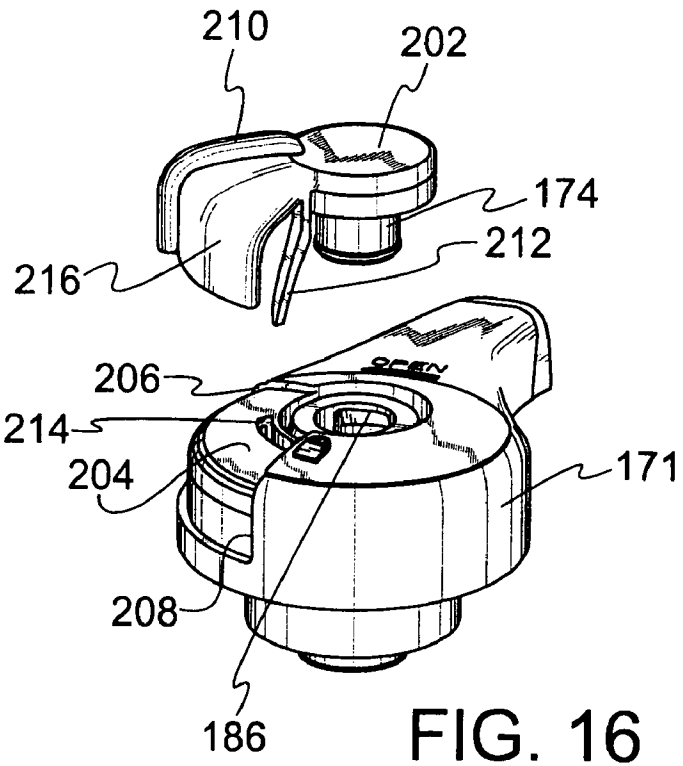
FIG. 16 is a perspective view showing an alternative locking mechanism for flow from the dispensing pump.

FIG. 16 shows yet another version of the arm and handle for the flow control valve as applied to a head 202 integral with sleeve 174. Sleeve 174 is rotated to register the outlet 184 (not shown in FIG. 16) with outlet passage 186 to permit or block flow. In this case, a head 171 has an arcuate recess 204 with end walls 206 and 208. An arm 210, integral with and extending radially from head 202, is received within arcuate recess 204. A flexible leaf spring 212 on arm 210 is received within arcuate slot 214 in head 171 and acts on a reaction surface (not shown) to bias arm 210 to a position against wall 208 where flow through outlet 186 is blocked. A cover 216 covers a portion of the arcuate slot 214.

In order for flow to be enabled when the unit is dispensing, arm 210 must be displaced to be against wall 206 simultaneously with the reciprocation of head 171 and associated pumping components. Thus, the locking mechanism of FIG. 16 requires that the arm 210 be simultaneously held in the unlocked position while pumping occurs. The moment an operator's finger is removed from arm 210, the valve is urged to its locked position thereby preventing unauthorized use.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. Apparatus for dispensing fluids comprising:

a pump assembly having a reciprocating plunger for pumping fluids, said plunger being rotationally threaded into a locked position and rotationally unthreaded to permit reciprocation; and apparatus selectively locking and unlocking said plunger to permit reciprocation, said selective locking apparatus requiring displacement other than rotational displacement substantially simultaneously with rotational movement of said plunger to enable said plunger to be unthreaded to permit reciprocation.

2. Apparatus as claimed in claim 1 wherein:

said pump assembly comprises a base into which said plunger is reciprocated, said plunger being threaded into said base to said locked position;

said selective locking apparatus comprises first and second elements, each connected to one of said plunger and base; and said first and second elements being displaceable between a first position permitting movement of said plunger substantially only toward said locked position and a second position permitting movement of said plunger toward said unlocked position.

3. Apparatus as claimed in claim 2 wherein said first element comprises a ratchet and said second element comprises at least one pawl flexibly engaging said ratchet in said first position.

4. Apparatus as claimed in claim 3 wherein said pawl comprises a flexible tab projecting toward said ratchet.

5. Apparatus as claimed in claim 2 wherein:

said first element is connected to one of said base and said plunger, said first element comprising a first ring having a plurality of recesses distributed around its circumference; and said second element is connected to the other of said base and said plunger, said second element comprising a second ring concentric with and rotatable relative to said first ring, and having a plurality of tabs; and said rings being axially displaceable relative to one another so that said tabs radially extend into said recesses when said rings are in said first position and are clear of said recesses in said second position.

6. Apparatus as claimed in claim 5 wherein said tabs extend in a non-radial direction and are flexibly biased into said recesses to permit relative rotation of said rings only in one direction when said rings are in said first position.

7. Apparatus as in claim 6 wherein said tabs comprise flexible elements integral with said second ring and formed to extend into said recesses.

8. Apparatus as claimed in claim 5 further comprising at least one spring for yieldably biasing said rings into said first position.

9. Apparatus as claimed in claim 8 wherein said spring comprises a pair of leaf springs positioned on one of said rings and abutting against one of the plunger and base to bias said rings into said first position as said plunger is threaded into said base.

10. Apparatus as claimed in claim 5 wherein said locking apparatus further comprises an operator manipulated element for applying movement to one of said rings to displace said rings into the second position.

11. Apparatus as claimed in claim 10 wherein:

said first ring is fixed to said base; and said second ring is connected to said plunger to permit limited displacement in the direction of the plunger reciprocation thereby axially displacing said rings between said first and second positions.

12. Apparatus as claimed in claim 11 wherein:

said plunger comprises a cover in which said second ring is received, said cover having a plurality of elongated openings extending in the direction of displacement of said second ring;

said second ring further comprises arms extending through said elongated openings and connected to said operator manipulating element; and said plunger further comprises elements for retaining said arms in said elongated openings.

13. Apparatus as claimed in claim 12 wherein said elongated openings are open-ended notches in said cover receiving said arms and said retaining elements comprises inwardly directed projections at the open end of said notches for permitting said arms to be snapped into said notches.

14. Apparatus as claimed in claim 13 further comprising at least one spring for axially biasing said second ring toward the first position of said rings.

15. Apparatus as claimed in claim 14 wherein said spring comprises a plurality of leaf springs connected to said second ring and abutting said plunger cover.

16. Apparatus as claimed in claim 12 wherein said operator manipulated element comprises a plurality of pads fixed to said arms radially outward from said plunger for permitting operator manipulation simultaneously with the unthreading of said plunger from said base.

17. Apparatus as claimed in claim 12 wherein said operator manipulated element comprises an actuation ring fixed to said arms radially outward therefrom for operator manipulation simultaneously with the unthreading of said plunger from said base.

18. Apparatus as claimed in claim 5 wherein:

said first ring is fixed to said base;

said second ring is connected to said base for limited axial movement between an upper and lower position relative to said base in the direction of plunger; and said apparatus further comprises a dog clutch between said plunger and said second ring, said dog clutch being engageable when said plunger is threaded into said base and said second ring is in its upper position and disengageable when said second ring is in its lower position thereby permitting said plunger to be unthreaded relative to said base.

19. Apparatus as claimed in claim 18 further comprising at least one spring for axially biasing said second ring to its upper position.

20. Apparatus as claimed in claim 19 wherein said biasing spring comprises a plurality of leaf springs fixed to said second ring and abutting said base to urge said second ring to its upper position.

21. Apparatus as claimed in claim 18 further comprising an actuation ring radially outward from said plunger and second ring and connected to said second ring for operator manipulation.

22. Apparatus as claimed in claim 2 wherein:

said plunger has an upper end to its stroke where it has a maximum extension from said base;

said plunger further comprises locking elements yieldably urged in an outward direction so as to prevent said plunger from downward movement from substantially the upper end of its stroke; and said locking elements requiring inward movement simultaneously with downward movement of said plunger to permit reciprocation from the upper end of its stroke.

23. Apparatus as claimed in claim 22 wherein said locking elements comprises a plurality of leaf springs fixed to said plunger so that when said leaf springs are compressed radially inward, reciprocation of said plunger into said base is permitted and when said plunger is at the top of its stroke said leaf springs extend radially outward to prevent reciprocation of said plunger into said base.

24. Apparatus as claimed in claim 2 wherein:

said first element comprises a flange fixed to one of said plunger and said base; and said second element comprises a plurality of dogs pivotally connected to the other of said plunger and base for embracing said flange in a locked position to prevent movement of said plunger away from its locked position and pivotable to a position standing clear of said flange in an unlocked condition to permit movement of said plunger to its unlocked position.

25. Apparatus as claimed in claim 24 further comprising at least one spring for biasing said dogs into said locked position.

26. Apparatus as claimed in claim 25 wherein:

said flange is fixed to said base;

said plunger comprises central pumping element and a cover in which said second element is received; and said second element comprises a ring embracing said central pumping element, each of said dogs being pivotally connected to said ring and having an extension beyond the pivot of said dogs and a button on said extension, said cover having an opening for receiving each button, whereby an operator can press said button radially inward to cause said dogs to stand clear of said flange and permit said plunger to be unthreaded.

27. Apparatus as claimed in claim 26 wherein said dogs, ring, extensions and buttons are made from a unitary plastic material formed to bias the dogs to a locking position.

28. Apparatus for dispensing fluids comprising:

a pump assembly having a reciprocating plunger for pumping fluids; and a valve for selectively blocking and permitting flow from said pump assembly, said selective flow valve being displaceable in a predetermined direction between a first position blocking and a second position permitting flow, said selective flow valve having a lock requiring substantially simultaneous displacement in a direction other than said predetermined direction to permit displacement to said second position to permit flow.

29. Apparatus as claimed in claim 28 wherein:

said reciprocating plunger comprises a pumping element and a cover incorporating a fluid outlet passage;

said selective flow valve comprises a valve element carried by said cover and displaceable in said predetermined direction between a first position blocking flow and a second position permitting flow; and said locks compress an arm connected to said valve element to enable selective movement in said predetermined direction towards the second position upon simultaneous displacement in a direction different than said predetermined direction of said valve element.

30. Apparatus as claimed in claim 29 wherein:

said valve element is rotatable between said first and second positions; and said selective movement arm is displaceable in a plane substantially radial relative to the rotation of said valve element.

31. Apparatus as claimed in claim 30 wherein said selective movement arm comprises:

an arm external to said cover and connected to said valve element; and ratchets on said cover and a pawl on said arm engageable with said ratchets to permit rotation of said arm only toward the first position of said valve, said arm being displaceable to move said pawl clear of said ratchets to permit rotation of said arm toward the second position of said valve.

32. Apparatus as claimed in claim 31 further comprising at least one spring for yieldably biasing said arm towards the first position of said valve.

33. Apparatus as claimed in claim 32 wherein said yieldable biasing spring comprises a flexible leaf spring fixed to said arm and abutting said cover to urge said arm towards the first position of said valve.

* * * * *